US010494881B2

(12) United States Patent
Andersen

(10) Patent No.: US 10,494,881 B2
(45) Date of Patent: Dec. 3, 2019

(54) HOISTING SYSTEM

(71) Applicant: MHWIRTH AS, Kristiansand S (NO)

(72) Inventor: Havard Andersen, Vennesla (NO)

(73) Assignee: MHWIRTH AS, Kristiansand S (NO)

( * ) Notice: Subject to any disclaimer, the term of this patent is extended or adjusted under 35 U.S.C. 154(b) by 58 days.

(21) Appl. No.: 15/571,277

(22) PCT Filed: Apr. 4, 2016

(86) PCT No.: PCT/NO2016/050060

§ 371 (c)(1),
(2) Date: Nov. 2, 2017

(87) PCT Pub. No.: WO2016/178582

PCT Pub. Date: Nov. 10, 2016

(65) Prior Publication Data

US 2018/0347291 A1 Dec. 6, 2018

(30) Foreign Application Priority Data

May 4, 2015 (NO) ..... 20150540

(51) Int. Cl.

| | |
|---|---|
| ***F15B 1/02*** | (2006.01) |
| ***F15B 1/027*** | (2006.01) |
| ***E21B 19/02*** | (2006.01) |
| ***E21B 19/086*** | (2006.01) |

(52) U.S. Cl.
CPC ..... *E21B 19/02* (2013.01); *E21B 19/086* (2013.01); *F15B 1/022* (2013.01); *F15B 1/027* (2013.01)

(58) Field of Classification Search
CPC ..... F14B 11/06; F14B 11/064; F14B 11/072; F14B 2211/21; F14B 11/11; F15B 11/06; F15B 11/064; F15B 11/072; F15B 2211/21; F15B 11/11
See application file for complete search history.

(56) References Cited

U.S. PATENT DOCUMENTS

| | | | | |
|---|---|---|---|---|
| 1,501,464 | A | 7/1924 | Patterson | |
| 3,804,183 | A | 4/1974 | Duncan et al. | |
| 4,351,261 | A * | 9/1982 | Shanks | B66C 13/02 114/264 |
| 6,032,929 | A | 3/2000 | Vatne | |
| 2016/0144932 | A1 | 5/2016 | Salen | |
| 2016/0376848 | A1 | 12/2016 | Taraldrud et al. | |

FOREIGN PATENT DOCUMENTS

| | | | |
|---|---|---|---|
| ES | 83 06 354 | A1 | 8/1983 |
| NO | 301384 | B1 | 10/1997 |
| SU | 1133374 | A | 1/1985 |
| WO | WO 88/07496 | A1 | 10/1988 |
| WO | WO 97/23705 | A1 | 7/1997 |
| WO | WO 2015/007412 | A2 | 1/2015 |
| WO | WO 2015/009163 | A1 | 1/2015 |

* cited by examiner

*Primary Examiner* — Michael Leslie
*Assistant Examiner* — Daniel S Collins
(74) *Attorney, Agent, or Firm* — Norman B. Thot

(57) ABSTRACT

The present invention provides a hoisting system which includes at least one hydraulic hoisting cylinder, a pressurized gas reservoir, and an emergency lifting line with a first valve. The emergency lifting line selectively leads a pressurized gas from the pressurized gas reservoir into the at least one hydraulic hoisting cylinder.

9 Claims, 3 Drawing Sheets

HOISTING SYSTEM

CROSS REFERENCE TO PRIOR APPLICATIONS

This application is a U.S. National Phase application under 35 U.S.C. § 371 of International Application No. PCT/NO2016/050060, filed on Apr. 4, 2016 and which claims benefit to Norwegian Patent Application No. 20150540, filed on May 4, 2015. The International Application was published in English on Nov. 10, 2016 as WO 2016/178582 A1 under PCT Article 21(2).

FIELD

The present invention relates to hydraulic hoisting systems, and more particularly to a hydraulic hoisting system comprising an arrangement to provide emergency lifting in a case of black out and/or loss of hydraulic power.

BACKGROUND

Hydraulic lifting systems are widely used in a range of areas and applications. One such application is offshore drilling where a hydraulic lifting or hoisting system can be used to lift drilling equipment. In such cases, the lifting system will need to carry very high loads, including both the drilling equipment (such as a top drive) and typically several hundred (or even thousand) meters of drill string extending towards the seafloor. Operational requirements also require that the lifting system be available for certain procedures in the case of an emergency, for example, to lift the drill string out of the BOP stack for an emergency disconnect.

High demands for reliability and availability therefore exist for such systems since the consequences (e.g., a well blow-out) in case of failures in such emergency situations can be extreme. A need therefore exists for systems and methods which further improve the reliability for hydraulic lifting systems used in offshore drilling and other applications.

SUMMARY

An aspect of the present invention is to provide improved reliability and to remedy defects of known solutions.

In an embodiment, the present invention provides a hoisting system which includes at least one hydraulic hoisting cylinder, a pressurized gas reservoir, and an emergency lifting line comprising a first valve. The emergency lifting line is configured to selectively lead a pressurized gas from the pressurized gas reservoir into the at least one hydraulic hoisting cylinder.

BRIEF DESCRIPTION OF THE DRAWINGS

The present invention is described in greater detail below on the basis of embodiments and of the drawings in which.

DETAILED DESCRIPTION

Figure 1:
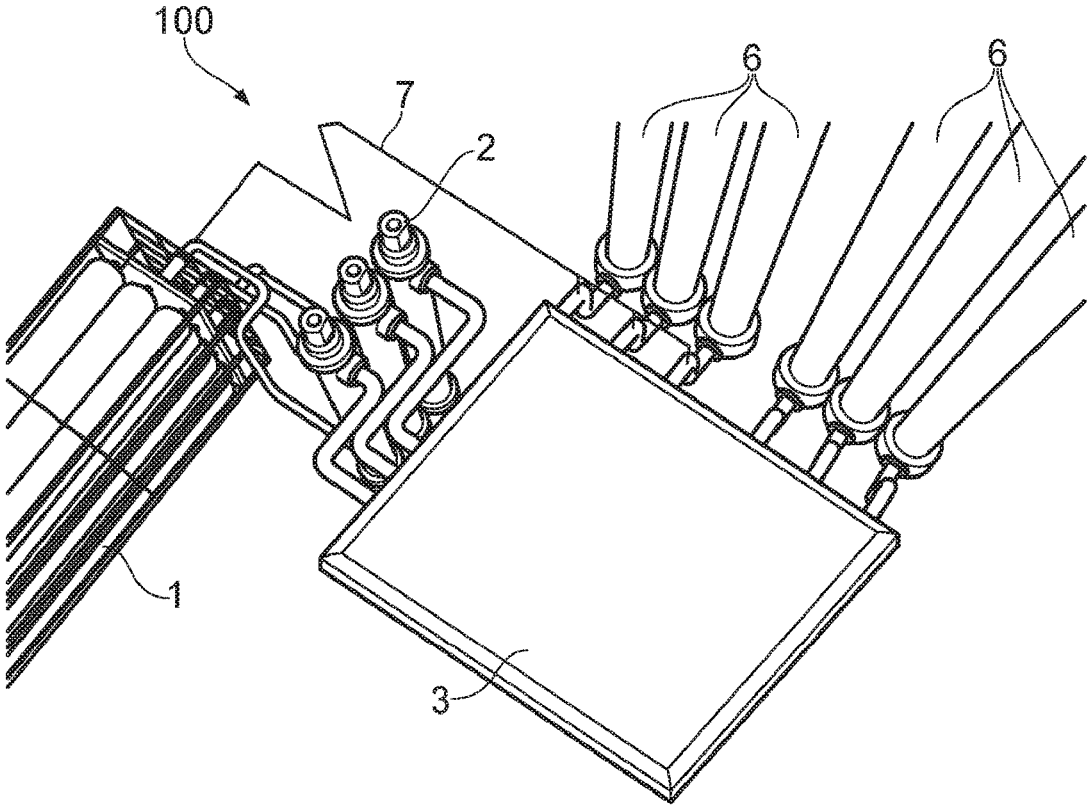
FIG. 1 shows an illustration of a possible configuration of a hoisting system according to the present invention.

In an embodiment, the present invention provides a hoisting system comprising at least one hydraulic hoisting cylinder, a pressurized gas reservoir, and an emergency lifting line adapted to selectively lead pressurized gas from the pressurized gas reservoir into the at least one hydraulic hoisting cylinder.

In an embodiment, the hoisting system can, for example, comprise an emergency lifting line which is adapted to selectively lead pressurized gas from a pressurized gas reservoir to at least one hoisting cylinder. This can advantageously provide emergency lifting capability in the absence of main hydraulic power.

In an embodiment, the pressurized gas reservoir can, for example, comprise at least one storage vessel or pressurized gas.

The pressurized gas reservoir may be dedicated for the purpose of feeding the emergency lifting line and, during normal operation of the hoisting system, remains in a stand-by position.

This may permit storage of pressurized gas in pressure vessels (e.g., high-pressure bottles) for use in an emergency situation, whereby these are not affected by other pressurized gas consumers. Such vessels can further be stored close to the hoisting system, thereby improving reliability and availability in case of, for example, physical damage, such as an explosion or blow-out on a drilling vessel.

In an embodiment, the hoisting system can, for example, further comprise at least one accumulator connected hydraulically to the hoisting cylinder, the at least one accumulator having a hydraulic side and a gas side, whereby the pressurized gas reservoir comprises at least one working pressure vessel operatively connected with the accumulator gas side.

The accumulator pressurized gas supply for emergency lifting may be used in an emergency situation.

In an embodiment, the pressurized gas reservoir can, for example, further comprise at least one storage vessel and a first valve which is adapted to selectively provide pressurized gas from either the working pressure vessel, from the storage vessel, or from both the working pressure vessel and the storage vessel to the emergency lifting line.

In an embodiment, the pressurized gas reservoir can, for example, comprise at least one storage vessel with a valve arranged to selectively supply pressurized gas from either (i) the working pressure vessel, (ii) the storage vessel, or (iii) both the working pressure vessel and the storage vessel to the emergency lifting line. This permits the use of high-pressure, stored gas from the accumulator supply for emergency lifting.

The emergency lifting line may be provided with a second valve which is adapted to selectively lead pressurized gas to one or more of the at least one hoisting cylinders.

This permits a selective use of pressurized gas in a number of cylinders in a multi-cylinder setup, thus avoiding the need to vent all cylinders for gas after an emergency lift has been carried out.

The pressurized gas reservoir may be provided with a capacity sufficient to drive one full stroke of the at least one hydraulic hoisting cylinder.

In an embodiment, the at least one hydraulic hoisting cylinder can, for example, be adapted to hoist a load on an offshore drilling rig.

In an embodiment, the present invention also relates to an offshore drilling vessel provided with a hoisting system as described above.

In an embodiment, the hoisting system can, for example, be provided with a pressurized gas reservoir sufficient to drive one full stroke of the hoisting cylinder(s). In an embodiment, the hoisting system can, for example, be adapted to hoist a load on an offshore drilling rig. In an embodiment, an offshore drilling vessel with a hoisting system according to the present invention can, for example, be provided. In an emergency, this allows an offshore drilling vessel to space out the drill string from the BOP stack for an emergency disconnect, for example, during a power system black-out.

An embodiment of the hoisting system of the present invention will be described below under reference to the drawings.

FIG. 1 shows the main components of a lifting (or hoisting) system 100 according to an embodiment of the present invention. The system 100 comprises a pressurized gas reservoir 1, here shown as a bank of nitrogen bottles, a bank of accumulators 2 (in this case three individual accumulators), hoisting valve blocks 3, and a set of main lifting cylinders 6 (in this case six cylinders). The system 100 as described above is a known solution used in offshore drilling applications; see, for example, FIG. 1 of NO 301384 for a typical configuration. In addition to the above, the present invention provides an emergency lifting line 7 which connects the pressurized gas reservoir 1 with the main lifting cylinders 6.

Figure 2:
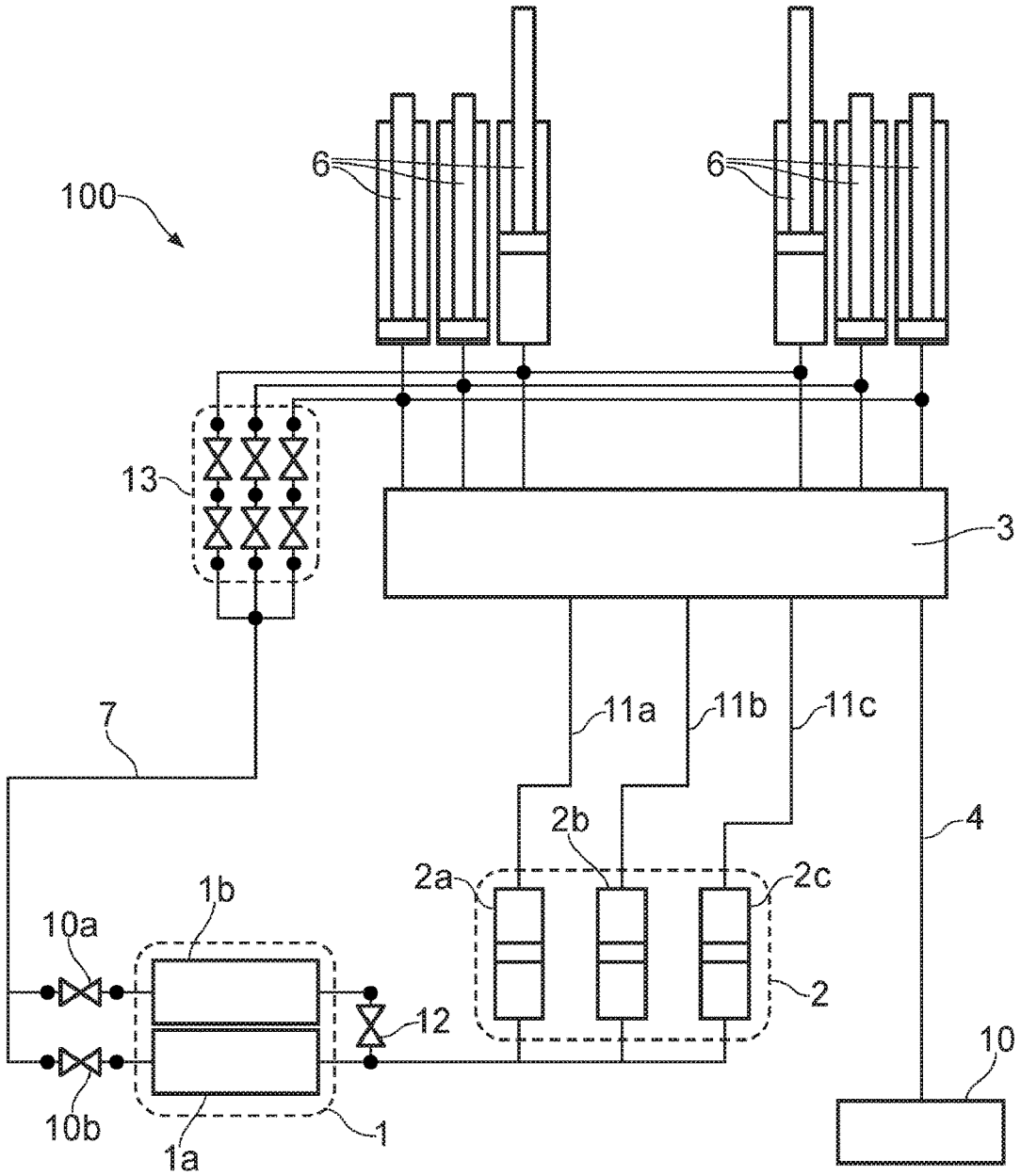
FIG. 2 schematically shows the operating arrangement of a hoisting system according to the present invention.

FIG. 2 schematically illustrates an embodiment of the operating arrangement of the system 100 and the hydraulic and pneumatic setup of the components described above. Under normal operation, external hydraulic power from a hydraulic power unit 10 is supplied to the hoisting valve blocks 3 through a hydraulic supply line 4. The external hydraulic power provides the energy for operation of the main lifting cylinders 6, and the hoisting valve blocks 3 are arranged to control the operation of the main lifting cylinders 6.

The bank of accumulators 2 is connected to the hoisting valve blocks 3 through hydraulic lines 11*a*, 11*b* and 11*c*, and is, during normal operation, hydraulically connected to the main lifting cylinders 6. The accumulators 2*a*, 2*b*, 2*c* each comprise a piston dividing the accumulator into a hydraulic side and a gas side, the gas side being connected to the pressurized gas reservoir 1. This setup provides passive heave compensation for the hoisting system when used on a vessel in that the compressibility of the gas in the accumulator bank 2 and pressurized gas reservoir 1 allows some movement (i.e., compression and expansion) of the main lifting cylinders 6 in response to changes in the load force acting on the hoisting system.

The pressurized gas reservoir 1 comprises a bank of pressure vessels, for example, nitrogen bottles (see FIG. 1), of which there is at least one working bottle 1*a* and at least one storage bottle 1*b*. The storage bottle 1*b* generally contains reserve gas under high pressure. In a normal operational configuration, the working bottle 1*a* is connected operatively to the accumulator bank 2, whereas the storage bottle 1*b* is closed and available when increased pressure or a top-up of the gas in the working bottle(s) is required. A valve 12 is provided for this purpose.

The system further comprises an emergency lifting line 7 providing a connection between the pressurized gas reservoir 1 and the main lifting cylinders 6. The emergency lifting line 7 is provided with valves 10*a* and 10*b*, which are closed under normal operation. Should an emergency situation arise, for example, a loss of hydraulic supply from hydraulic supply line 4, the emergency lifting line 7 provides the opportunity to selectively lead pressurized gas from the pressurized gas reservoir 1 directly to the main lifting cylinders 6, i.e., into the fluid chamber of the main lifting cylinders 6. This can be done directly into the cylinder hydraulic inlet pipe or, alternatively, via valves in the hoisting valve blocks 3. Valves 10*a* and 10*b* selectively allow an opening for supply to the emergency lifting line 7 from the storage bottle 1*b* and/or from the working bottle 1*a*.

The pressurized gas reservoir 1 can, for example, be provided with sufficient capacity to drive at least one full stroke of the main lifting cylinders 6, i.e., a volume of gas equivalent to the full displacement of the main lifting cylinders 6 under the relevant pressure conditions.

The emergency lifting line may also comprise valves 13 to selectively lead gas to individual or pairs of the main lifting cylinders 6 in a multi-cylinder system. This eliminates the need to vent out pressurized gas from all the main lifting cylinders 6 after use of the system 100 for emergency lifting.

Figure 3:
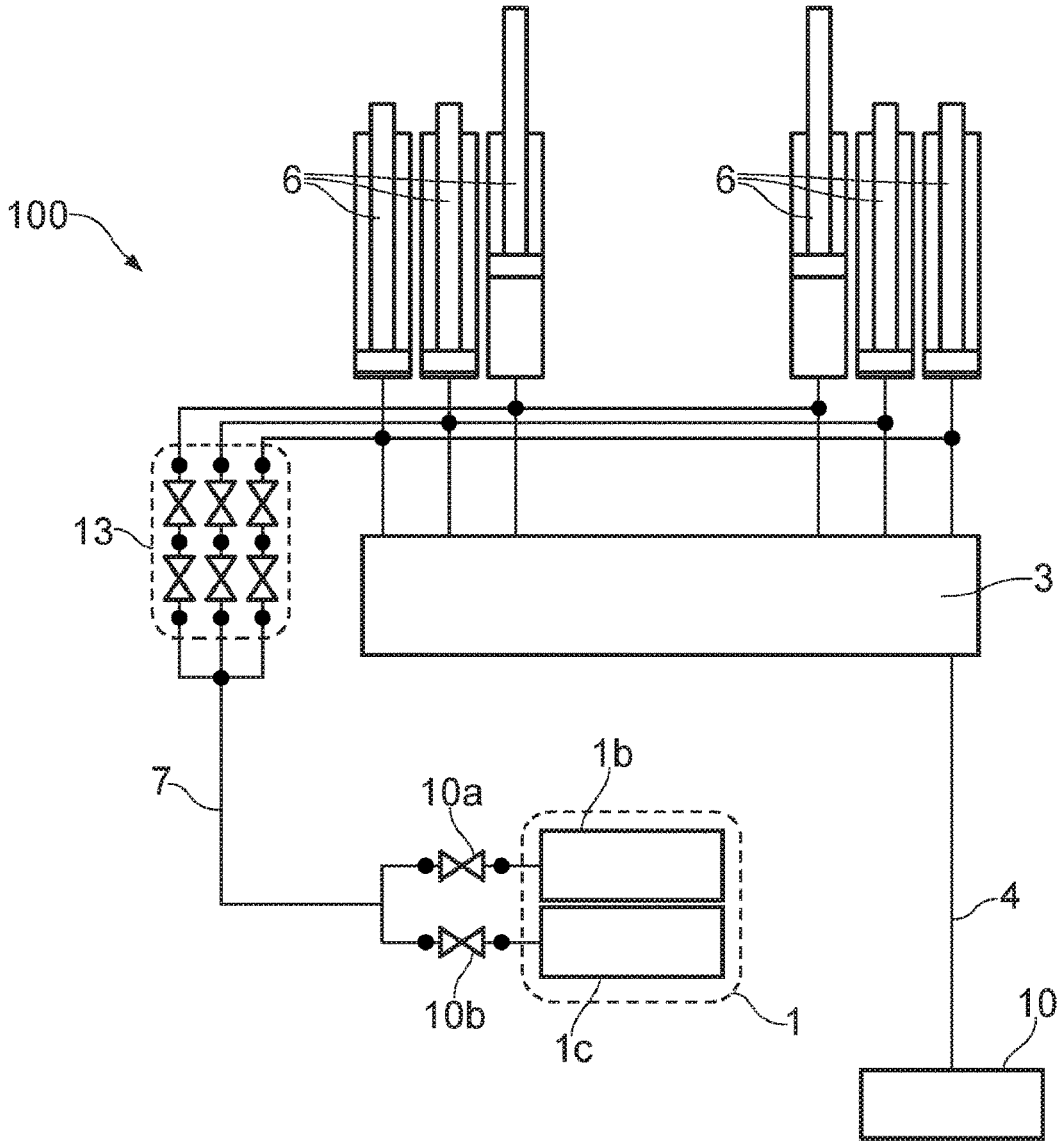
FIG. 3 schematically shows an alternative operating arrangement according to the present invention.

FIG. 3 shows an alternative embodiment according to the present invention. FIG. 3 shows a hoisting system 100 for a drilling rig comprising hydraulic lifting cylinders 6 (as above) powered by an external hydraulic power unit 10 controlled by hoisting valve blocks 3. A pressurized gas reservoir 1 is provided comprising two gas storage bottles 1*b* and 1*c*. Valves 10*a* and 10*b* are provided to selectively admit pressurized gas from bottles 1*b* and/or 1*c* to the emergency lifting line 7 and thus further to the hydraulic lifting cylinders 6. The pressurized gas reservoir 1 is provided with sufficient capacity to drive at least one full stroke of the hydraulic lifting cylinders 6. In an embodiment, the pressurized gas reservoir 1 can, for example, be provided as a dedicated reservoir for emergency lifting, being in a standby position during normal operation, and ideally placed close to the hoisting system.

The emergency lifting line may also comprise valves 13 to selectively lead gas to individual or pairs of the hydraulic lifting cylinders 6 in a multi-cylinder system. This eliminates the need to vent out pressurized gas from all the hydraulic lifting cylinders 6 after use of the system for emergency lifting.

The system as exemplified above and as defined in the claims thus provides the opportunity to also carry out a lifting operation in the case of power loss. By designing the pressurized gas reservoir 1 with sufficient pressure and/or capacity, one can provide that it is possible to operate the lifting system in a loaded condition for at least one full lifting stroke, also in the absence of hydraulic power supply. Despite the substantial disadvantages associated with leading gas into the hydraulic system (including the need for venting gas out, loss of lubrication, etc.), this means that it would be possible in an offshore drilling vessel to, for example, space out the drill string in the BOP stack for an emergency disconnect during a power system black-out.

The present invention is not limited to embodiments described herein; reference should be had to the appended claims.

What is claimed is:

1. A hoisting system comprising:

at least one hydraulic hoisting cylinder comprising a fluid chamber which is connected to a source of hydraulic power;

a pressurized gas reservoir; and an emergency lifting line comprising a first valve, the emergency lifting line being configured to selectively lead a pressurized gas from the pressurized gas reservoir into the fluid chamber of the at least one hydraulic hoisting cylinder.

2. The hoisting system as recited in claim 1, wherein the pressurized gas reservoir comprises at least one storage vessel for the pressurized gas.

3. The hoisting system as recited in claim 2, wherein the pressurized gas reservoir is configured to feed the emergency lifting line and, during a normal operation of the hoisting system, to remain in a stand-by position.

4. The hoisting system as recited in claim 1, further comprising:

at least one accumulator which is hydraulically connected to the at least one hoisting cylinder, the at least one accumulator comprising a hydraulic side and a gas side, wherein, the pressurized gas reservoir comprises at least one working pressure vessel which is operatively connected with the gas side of the at least one accumulator.

5. The hoisting system as recited in claim 4, wherein the pressurized gas reservoir further comprises at least one storage vessel and a first valve, the pressurized gas reservoir being configured to selectively provide the pressurized gas from at least one of the at least one working pressure vessel and the at least one storage vessel to the emergency lifting line.

6. The hoisting system as recited in claim 1, wherein the emergency lifting line further comprises a second valve which is configured to selectively lead the pressurized gas to at least one of the at least one hoisting cylinder.

7. The hoisting system as recited in claim 1, wherein the pressurised gas reservoir comprises a capacity sufficient to drive one full stroke of the at least one hydraulic hoisting cylinder.

8. The hoisting system as recited in claim 1, wherein the at least one hydraulic hoisting cylinder is configured to hoist a load on an offshore drilling rig.

9. An offshore drilling vessel comprising the hoisting system as recited in claim 1.

* * * * *